US012291967B1

(12) United States Patent
Dimitroff

(10) Patent No.: US 12,291,967 B1
(45) Date of Patent: May 6, 2025

(54) METHOD FOR FORMING UNDERGROUND FLOWLINES WITH ELECTRONIC TRACKING

(71) Applicant: Ted R. Dimitroff, Columbia, MO (US)

(72) Inventor: Ted R. Dimitroff, Columbia, MO (US)

( * ) Notice: Subject to any disclaimer, the term of this patent is extended or adjusted under 35 U.S.C. 154(b) by 120 days.

(21) Appl. No.: 18/541,898

(22) Filed: Dec. 15, 2023

(51) Int. Cl.
*E21B 7/28* (2006.01)
*E21B 7/04* (2006.01)
*E21B 47/09* (2012.01)

(52) U.S. Cl.
CPC ..... *E21B 7/28* (2013.01); *E21B 7/046* (2013.01); *E21B 47/09* (2013.01)

(58) Field of Classification Search
CPC ..... E21B 7/28; E21B 7/046; E21B 47/09
See application file for complete search history.

(56) References Cited

U.S. PATENT DOCUMENTS

| | | | | |
|---|---|---|---|---|
| 574,661 | A | 1/1897 | Carroll | |
| 4,412,673 | A | 11/1983 | Ramsden et al. | |
| 5,507,597 | A | 4/1996 | McConnell | |
| 5,580,188 | A | 12/1996 | Nowak | |
| 6,732,816 | B2 | 5/2004 | Dimitroff | |
| 6,761,507 | B2 | 7/2004 | Wentworth et al. | |
| 6,792,820 | B2 | 9/2004 | Wentworth et al. | |
| 7,086,808 | B2 | 8/2006 | Wentworth et al. | |
| 7,251,567 | B2 * | 7/2007 | Nickel | G01C 17/00 702/9 |
| 7,255,516 | B2 | 8/2007 | Wentworth et al. | |
| 7,581,600 | B1 * | 9/2009 | Dimitroff | E21B 7/046 405/184 |
| 7,674,072 | B2 | 3/2010 | Shook et al. | |
| 8,641,326 | B2 | 2/2014 | Dimitroff | |
| 2004/0188142 | A1 * | 9/2004 | Self | E21B 7/06 175/406 |
| 2012/0219363 | A1 * | 8/2012 | Dimitroff | F16L 55/1658 405/184.1 |
| 2017/0226805 | A1 * | 8/2017 | Cole | E21B 7/046 |

OTHER PUBLICATIONS http://www.trenchlessflowline.com/technology.html, accessed on Mar. 25, 2024 (Year: 2024).*

* cited by examiner

*Primary Examiner* — Theodore N Yao
(74) *Attorney, Agent, or Firm* — McKee, Voorhees & Sease, PLC

(57) ABSTRACT

A method of drilling a flowline below ground surface includes the step of supporting a pilot rod of a directional boring machine with hooks extending downwardly through substantially vertical relief holes while the rod bores an underground pilot hole. The hooks are removed as the rod pulls a reamer head backwards through the pilot hole to form a large diameter pipe hole so that the reamer head does not hit the hooks. The location of the reamer head is tracked or monitored using a transmitter on the pilot rod which sends a signal to an above ground receiver, so that an operator knows when to stop the back reaming process and temporarily remove each support hook as the reamer head approaches the vertical hole.

17 Claims, 1 Drawing Sheet

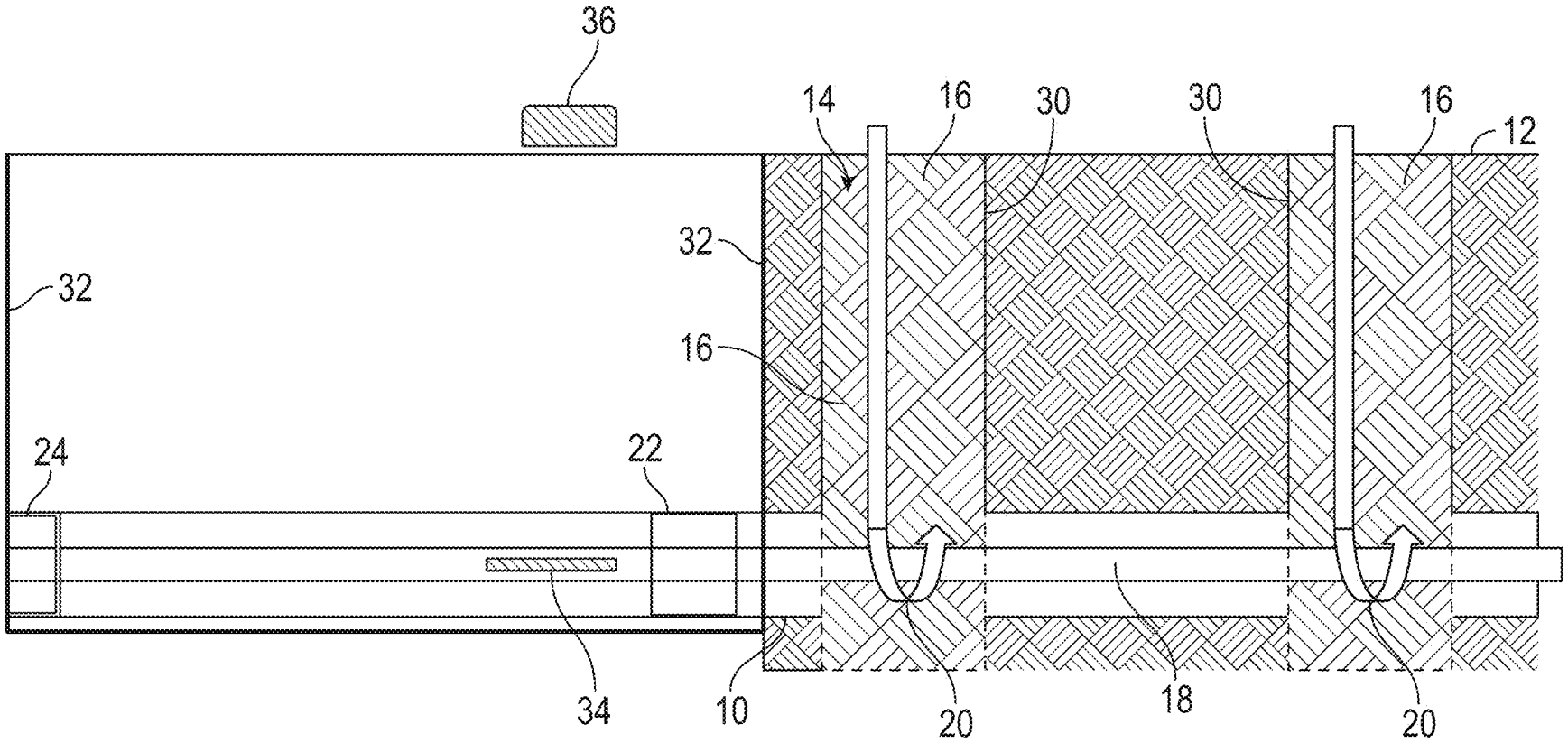
12
16
30
30
16
14
32
36
32
16
20
18
20
10
22
34
24

METHOD FOR FORMING UNDERGROUND FLOWLINES WITH ELECTRONIC TRACKING

TECHNICAL FIELD

The invention is directed toward an improved directional boring process for forming underground flowlines with improved accuracy using electronic tracking of a back reamer head.

BACKGROUND

Directional boring has become a common process for creating underground flowlines, such as for storm sewers and other types of fluid carrying pipelines. Directional boring is used for new pipeline installation as well as replacement of old pipelines. Directional boring overcomes problems associated with open trenches, tunneling, and auger boring. Accuracy is important in the boring process to achieve proper flow through the pipeline.

U.S. Pat. Nos. 7,581,600 and 8,641,326 describe improved directional boring processes which support the pilot stem with hooks. The hooks help maintain the pilot stem or rod of the directional boring machine on an accurate line as the pilot hole is drilled. While the process as described in these patents provides improvements over conventional directional boring, further improvements in boring accuracy would provide additional benefits in installation and use of underground utilities. For example, the location of the back reamer is estimated so that the support hooks can be removed to avoid being hit by the back reamer head. If the hooks are removed while the back reamer head is too far away, accuracy of the flowline is compromised. If the reamer head hits a support hook, the hook and/or the reamer head can be damaged. If the support hook becomes wrapped around the reamer head, the boring operation must be stopped to separate the hook and head, both of which may need to be repaired or replaced. This increases costs and delays the boring operation.

Therefore, a primary objective of the present invention is the provision of an improved method of tracking the back reamer head for improved accuracy in the line and grade of the pipe to be installed.

Another objective of the present invention is the provision of a method of drilling and underground flowline using electronic controls for accuracy of the drilling equipment.

Still another objective of the present invention is the provision of an improved method of drilling a flowline below ground surface that utilizes a beacon adjacent the reamer head which transmits a signal to a receiver above ground so as to monitor the location of the reamer head.

A further objective of the present invention is the provision of an improved directional boring method which tracks the location of the reamer head so as to avoid contact with the pilot stem support hooks.

Still another objective of the present invention is the provision of an improved directional boring process that supports the drilling rod with hooks extending downwardly through vertical site relief holes, and wherein the hooks are temporarily and sequentially removed after stopping the back reamer in close proximity to the hooks to allow the back reamer head to pass through the site relief hole without hitting a support hook.

These and other objectives become apparent from the following description of the invention.

SUMMARY

The A method of drilling a flowline below ground surface comprises a step of making a series of substantially vertical site relief holes extending downwardly from the surface of the ground. Then, the pilot stem or rod of a directional boring machine drills a pilot hole in a first direction which intersects each of the vertical site relief holes. After passing through each site relief hole, the boring stem or rod is supported by a hook or other support tool extending downwardly through each site relief hole. After the pilot hole is complete, a reamer head is attached to the pilot stem or rod and pulled in a second opposite direction to increase the diameter of the pilot hole. The reamer head is tracked during the back reaming process so that as the reamer head approaches each site relief hole, the support hook can be temporarily removed so that the reamer head does not hit the support hook. After the reamer head passes through the site relief hole, the support hook can be reinstalled to support the pilot stem or rod. The tracking of the reamer head location is accomplished wirelessly, with a transmitter positioned on the stem or rod adjacent the reamer head which sends a signal to a receiver above ground. The operator can stop the back reaming process to remove the support hook before the reamer head reaches the support hook, so as to prevent damage to the reamer head or to the hook.

BRIEF DESCRIPTION OF THE DRAWINGS

FIG. 1 is a schematic view of the improved method for installing an underground flowline, according to the present invention.

DETAILED DESCRIPTION

The method of the present invention can be used for new flowline installation, for new pipelines or for replacement of old pipelines. The process is essentially the same for both a new pipeline and replacement of an old pipeline, except that the reamer head will break up an old pipeline as the reamer head creates a hole for installation of the replacement pipeline. FIG. 1 illustrates the process for an old pipeline replacement, and it is understood that a new flowline creation is the same except that the old pipe does not exist.

As seen in FIG. 1, the existing pipe 10 is buried beneath the surface of the ground 12. The first step of the method involves drilling a series of spaced apart vertical site relief holes 14 from the surface 12, and through the existing pipe (if an old pipe exists). Preferably, water or other liquid is used in this drilling process to lubricate the drill and to form a slurry with the soil. This slurry fills the existing pipe 10, and may extend upwardly within the vertical site relief holes 14.

Then, a directional boring machine with a pilot stem or rod 18 is used to drill a pilot hole in a first direction, indicated by arrow A in FIG. 1. After the stem or rod passes through the site relief hole 14, a support hook or tool 20 is extended downwardly through the site relief hole 14, and hooked beneath the pilot stem or rod 18. The slurry 16 surrounds the pilot stem 18, and acts as a dampening agent to prevent the pilot stem 18 from flipping, jumping, or moving off the support hooks 20. The slurry 16 also lubricates the hooks 20 to minimize friction and to prevent overheating and abnormal wear on the pilot stem 18 or the hooks 20.

Next, a back reaming tool or head 22 is attached to the pilot stem or rod 18 and is pulled rearwardly in an opposite direction, as indicated by arrow B in FIG. 1. The reamer head 22 has a diameter equal to or slightly larger than the outside diameter of the existing old pipe 10, so as to break up the old pipe and form a new borehole for receiving a new pipe. The new pipe is connected to a pulling head 24 attached to the stem or rod 18 and is pulled into position as the reamer head 22 forms the new borehole.

Additional liquid can be used during the back reaming process to produce additional slurry. After the new pipe is installed, the slurry 16, which carries the broken old pipe pieces, is removed through the site relief holes 14 using a vacuum or other conventional means. The diameter of the reamer head 22 is approximately ½ inch larger in diameter than the new pipe diameter.

Each site relief hole 14 may be lined with a tube 30 to maintain the sidewall of the hole 14 and to prevent cave-in of soil from the sidewall. A work pit 32 with appropriate shoring protection is provided at one end of the existing pipe 10 or the end of the new pipeline.

In the improved directional boring process of the present invention, the location of the reamer head 22 is tracked electronically and wirelessly. A transmitter 34, such as a commercially available beacon, is placed on the stem or rod 18 adjacent the reamer head 22. As seen in FIG. 1, a preferred location for the transmitter 34 is immediately behind the reamer head 22, though the transmitter could also be located inside the reamer head or in front of the reamer head. The transmitter 34 sends a signal to an above ground receiver 36 wherein the signal corresponds to the location of the reamer head 22, so that an operator can stop the back reaming process as the reamer head 22 approaches each site relief hole 14. With the back reaming process stopped, the support hook 20 can be removed from the pilot stem 18, and then the back reaming process continued. After the reamer head 22 passes through the site relief hole 14, the support hook 20 can be reinstalled to support the rod 18 as the back reaming process continues. This process repeats itself so that the hooks 20 are sequentially removed from each site relief hole 14 as the reamer head 22 approaches each hole.

One example of a commercially available transmitter or beacon 34 is a DCI Purple Color Beacon, and one example of a commercially available receiver 36 is a DCI/Digital Control Inc. Eclipse Locator. Other transmitters and receivers that function in a similar manner can also be used in the process of this invention.

The "scope" of the present disclosure is defined by the appended claims, along with the full scope of equivalents to which such claims are entitled. The scope of the disclosure is further qualified as including any possible modification to any of the aspects and/or embodiments disclosed herein which would result in other embodiments, combinations, subcombinations, or the like that would be obvious to those skilled in the art.

What is claimed is:

1. A method of drilling a flow line below ground surface, comprising:

making series of substantially vertical sight relief holes;

then drilling a pilot hole in a first direction to each sight relief hole using a boring tool of a directional boring machine;

supporting the boring tool at selected ones of the sight relief holes with support hooks extending downwardly in the sight relief holes;

then reaming the pilot hole to a larger diameter using a reamer head pulled in a second direction opposite the first direction;

sensing the location of the reamer head during reaming;

stopping the reaming before the reamer head reaches each one of the support hooks, and then removing each one of the support hooks from the boring tool before reaming continues, and reinstalling each one of the support hooks to the boring tool after the reamer head passes the sight relief hole.

2. The method of claim 1 wherein the reamer head location is sensed electronically.

3. The method of claim 1 wherein the reamer head is sensed with a beacon.

4. The method of claim 3 wherein the beacon is mounted on the boring tool adjacent the reamer head.

5. The method of claim 3 further comprising positioning a receiver above ground to receive a signal from the beacon.

6. The method of claim 1 wherein the reamer head passes through each sight relief hole without hitting the support hook.

7. The method of claim 1 wherein each one of the support hooks are removed and replaced sequentially.

8. The method of claim 1 wherein only one of the support hooks is removed and replaced before a next hook is removed.

9. A method of drilling a flow line below ground surface, comprising:

supporting a rod of a directional boring machine with hooks extending downwardly through substantially vertical holes while the rod bores an underground pilot hole;

removing the hooks as the rod pulls a reamer head backwards through the pilot hole to form a pipe hole so that the reamer head does not hit the hooks;

tracking the reamer head as the pipe hole is formed to allow each hook to be removed before the reamer head reaches each hook; and reinstalling each hook to support the rod after the reamer head passes each vertical holes.

10. The method of claim 9 wherein each of the hooks is removed and replaced before another of the hooks is removed.

11. The method of claim 9 wherein the tracking includes sending a signal from a transmitter adjacent the reamer head to a receiver above ground.

12. The method of claim 11 further comprising positioning the transmitter in front of the reamer head on the rod.

13. The method of claim 11 wherein the tracking is accomplished electronically.

14. The method of claim 9 wherein the tracking is done wirelessly.

15. The method of claim 9 wherein the pilot hole and the pipe hole are formed in opposite directions.

16. The method of claim 9 further comprising installing a beacon on the rod before the pipe hole is formed to sense location of the reamer head relative to the vertical holes as the pipe hole is formed.

17. The method of claim 16 wherein the beacon sends a signal to an operator to notify the operator when to remove the hooks from the rod and raise the hooks out of a path of the reamer head.

* * * * *